US006736771B2

(12) United States Patent
Sokolich et al.

(10) Patent No.: US 6,736,771 B2
(45) Date of Patent: May 18, 2004

(54) WIDEBAND LOW-NOISE IMPLANTABLE MICROPHONE ASSEMBLY

(75) Inventors: W. Gary Sokolich, Newport Beach, CA (US); Janusz A. Kuzma, Parker, CO (US)

(73) Assignee: Advanced Bionics Corporation, Sylmar, CA (US)

( * ) Notice: Subject to any disclaimer, the term of this patent is extended or adjusted under 35 U.S.C. 154(b) by 0 days.

(21) Appl. No.: 10/324,183

(22) Filed: Dec. 20, 2002

(65) Prior Publication Data

US 2003/0125602 A1 Jul. 3, 2003

Related U.S. Application Data

(62) Division of application No. 10/038,041, filed on Jan. 2, 2002, now abandoned.

(51) Int. Cl.[7] ..... H04R 25/00
(52) U.S. Cl. ..... 600/25; 607/57
(58) Field of Search ..... 600/25; 607/55–57; 181/128–137; 381/312–316

(56) References Cited

U.S. PATENT DOCUMENTS 6,272,382 B1 * 8/2001 Faltys et al. ..... 607/57
6,422,991 B1 * 7/2002 Jaeger ..... 600/25
6,589,229 B1 * 7/2003 Connelly et al. ..... 604/890.1

* cited by examiner

*Primary Examiner*—John P. Lacyk
(74) *Attorney, Agent, or Firm*—Bryant R. Gold

(57) ABSTRACT

An implantable microphone assembly for use with a hearing prosthesis, such as a fully implantable cochlear stimulation system, includes a diaphragm mounted to an outside surface of an hermetically sealed case. The mounting is made, in one of various embodiments, by way of an hermetic weld around the diaphragm circumference. A gap is created on the underside of the diaphragm when the diaphragm is lifted with internal pressure. An acoustic channel or groove is formed in the wall of the hermetic case to which the diaphragm is mounted. A first end of the channel or groove opens into the gap at a location that is at or near the center of the underside of the diaphragm. A second end of the channel or groove opens to the interior of the hermetic case at a location that is near the periphery of the diaphragm. An acoustic transducer is placed inside the hermetic case and coupled to the second end of the acoustic channel or groove so as to sense variations in pressure that occur in the gap due to deflections of the diaphragm caused, e.g., by external sound pressure. The interior space inside of the hermetic case directly underneath the diaphragm may be used to house and mount other components, such as a battery. The interior of the hermetic case, which interior includes the gap and acoustic channel, is pressurized in order to lift the diaphragm to form the gap and enable the diaphragm to move in response to external forces, such as forces created by sound impinging the skin above the area where the implantable microphone is implanted.

21 Claims, 6 Drawing Sheets

WIDEBAND LOW-NOISE IMPLANTABLE MICROPHONE ASSEMBLY

The present application is a divisional of U.S. application Ser. No. 10/038,041, filed Jan. 2, 2002, now abandoned.

BACKGROUND OF THE INVENTION

The present invention relates to implantable microphones, and more particularly to an implantable microphone usable with an implantable hearing aid system, or similar auditory prosthesis, that provides a significantly wider frequency response and improved signal-to-noise than has heretofore been achievable.

Cochlear implant technology allows those who are profoundly deaf to experience the sensation of sound. Current cochlear implant systems include both internal, or implanted, components and external, or non-implanted, components. Typically, the implanted components have comprised an implantable pulse generator (IPG) connected to a cochlear electrode array adapted to be inserted into the cochlea. The external components have typically comprised an external microphone connected to an external speech processor, and a headpiece connected to the speech processor. In operation, the external microphone senses airborne sound and converts it to an electrical signal. The speech processor amplifies the signal and processes it in accordance with a desired speech processing strategy. After processing, control signals, fashioned to be representative of the information contained within the sound sensed by the microphone, are coupled to the IPG through the headpiece, and the IPG responds to these control signals by applying electrical stimuli to selected electrodes on the electrode array. Such electrical stimuli are sensed by the auditory nerve and transferred to the brain as the perception of sound.

Representative cochlear implant systems are described, e.g., in U.S. Pat. Nos. 3,752,939; 4,357,497; 4,679,560; and 5,603,726; which patents are incorporated herein by reference.

A significant problem associated with a fully implantable system is the microphone component thereof. An implantable microphone must be able to sense airborne sound from a location within the body tissue where the microphone is implanted. Conventional microphones that are designed to operate in air are not suitable for this purpose. Representative approaches that have been proposed in the art for an implantable microphone are found, e.g., in U.S. Pat. Nos. 5,888,187; 6,093,144; 6,216,040; and 6,422,991, and in U.S. patent applications Ser. Nos. 09/514,100, filed Feb. 28, 2000; and 09/854,420, filed May 11, 2001 (both applications are assigned to the same assignee as the present application); all of which documents are incorporated herein by reference.

Prior approaches for realizing an implantable microphone for use with a fully implantable system lack the signal-to-noise ratio and frequency response needed to allow a user of such implantable microphone to sense sounds beyond very basic speech sounds in a quiet environment.

SUMMARY OF THE INVENTION

The present invention is directed to an implantable microphone assembly suitable for use with an implantable hearing prosthesis, such as a fully implantable cochlear stimulation system, wherein the implantable microphone assembly exhibits, among other features, a wide frequency response and a high signal-to-noise ratio.

An implantable microphone assembly made in accordance with the present invention includes a diaphragm mounted to an outside surface of an hermetically sealed case. The mounting is made, in one of various embodiments, by way of an hermetic weld around the circumference of the diaphragm. A gap is created on the underside of the diaphragm when the diaphragm is lifted with internal pressure. At least one radial acoustic channel is formed in the wall of the hermetic case to which the diaphragm is mounted. A first end of the channel opens into the gap at a location that is at or near the center of the underside of the diaphragm. A second end of the radial acoustic channel opens to the interior of the hermetic case at a location that is near the periphery of the diaphragm. An acoustic transducer is placed inside the hermetic case and coupled to the second end of the acoustic channel so as to sense variations in pressure that occur in the gap due to deflections of the diaphragm caused, e.g., by external sound pressure. The interior space inside of the hermetic case directly underneath the diaphragm may be used to house and mount other components, such as a battery. The interior of the hermetic case, which interior includes the gap and radial channel, is pressurized in order to lift the diaphragm to form the gap and enable the diaphragm to move in response to external sound pressure.

BRIEF DESCRIPTION OF THE DRAWINGS

The present invention will be better understood from the following more particular description thereof, presented in conjunction with the following drawings wherein.

DETAILED DESCRIPTION OF THE INVENTION

Figure 1:
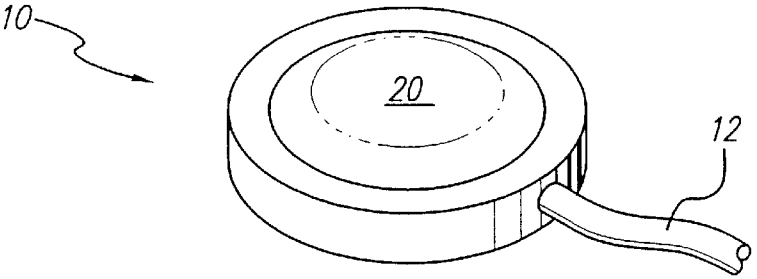
FIG. 1 is a perspective view of an implantable housing on and in which a microphone assembly made in accordance with the present invention is carried.

The following description is of the best mode presently contemplated for carrying out the invention. This description is not to be taken in a limiting sense, but is made merely for the purpose of describing the general principles of the invention. The scope of the invention should be determined with reference to the claims.

The present invention is directed to an implantable microphone suitable for use with a hearing prosthesis, such as a fully implantable cochlear stimulation system. Such implantable microphone provides a much wider frequency response and higher signal-to-noise ratio than has heretofore been achievable. A wider frequency response, in turn, allows the user of the microphone to hear a wider spectrum of sounds, i.e., to hear more sound, than has previously been possible. Being able to hear more sound allows the fully implantable system, with appropriate processing circuitry, to significantly enhance the ability of the user to perceive all audible sounds, e.g., not only voice sounds, but other sounds, such as music; as well as to sense such sounds in a noisy environment.

The microphone of the present invention comprises an hermetically sealed wideband microphone assembly having a high signal-to-noise ratio. Such microphone comprises a critical and necessary element in a fully implantable hearing prosthesis system, such as a cochlear implant system. Such microphone may also be used with any hearing system, e.g., a partially implanted hearing aid system.

A microphone converts an input pressure to an electrical output. To accomplish this, most microphones, including the microphone of the present invention, utilize a diaphragm to sense the incoming sound or pressure waves. The diaphragm is mounted or coupled to an appropriate acoustic transducer that converts pressure variations to an electrical signal.

Disadvantageously, because the microphone is implanted, there may be a significant thickness of skin and other body tissue in front of the diaphragm, all of which tends to affect the response of the microphone. To minimize the affects of the skin and tissue, the present invention incorporates a relatively high acoustic stiffness, as described more fully below.

The implantable microphone assembly of the present invention addresses at least three problems: (1) it minimizes the acoustic input compliance at the plane of the diaphragm; (2) it minimizes the acoustic compliance behind the diaphragm; and (3) it measures sound pressure directly below the center of the diaphragm with a remote miniature transducer located near the periphery of the assembly housing.

The first problem is addressed in order to achieve the widest possible bandwidth. The second problem is addressed in order to minimize the pressure drop across the diaphragm. The third problem is addressed in order to circumvent the packaging constraints associated with a fully implantable system. That is, the microphone assembly must be included in or on an hermetically sealed housing or case which also houses other components, such as electronic circuitry and an internal battery. The size and location of the internal battery prevents the transducer from being mounted underneath the center of the diaphragm, thereby requiring it to be located at the periphery of the diaphragm.

The implantable microphone assembly described herein offers, among other advantages, at least the following advantages: (1) a wide bandwidth; (2) a sensitivity and signal-to-noise ratio that is comparable to that of a high-quality hearing aid microphone; and (3) a design whose response is relatively insensitive to the thickness of skin and connective tissue in front of the diaphragm.

Turning to FIG. 1, a perspective view of a representative implantable device 10 is shown. The implantable device 10 may comprise any of a wide variety of implantable devices, e.g., an implantable speech processor used in combination with an implantable pulse generator as taught in U.S. Pat. No. 6,272,382. A diaphragm 20 is attached to an outside surface of the device 10. One or more cables 12 may exit from the device 10 to allow electrical connection to be made with electrical components housed within the implantable device. For example, the cable 12 may connect with another implantable device, e.g., an implantable pulse generator; or it may be connected to an electrode array through which electrical stimuli may be applied to surrounding tissue; or it may be connected to an antenna that allows electromagnetic or radio frequency (RF) communications to be made with the device 10. In other variations of the implantable device 10, the cable 12 may be connected to an array of sensors adapted to sense various physiological parameters that are monitored by the implantable device. In further variations of the implantable device 10, e.g., wherein the function of the implantable device may be carried out by circuitry and components that are self contained within the implantable device, the cable 12 may be absent. An example of such a self-contained implantable device wherein the cable 12 may not be needed is an implantable microphone that is coupled to another device through a radio frequency (rf) link by way of an internal antenna, or through an optical link, or through an electromagnetic link.

The cable 12, when used, may be hard wired to the implantable device 10, or in some embodiments may be detachably connected to the implantable device 10 by way of a connector. The manner in which the cable 12, when present, connects to the electrical components within the hermetically sealed device is not relevant to the present invention, and is thus not described. In general, such connection, whether hard wired or established through a connector is made through the use of feed-through terminals, as is known in the art. See, e.g., U.S. Pat. No. 6,321,126.

Figure 2A:
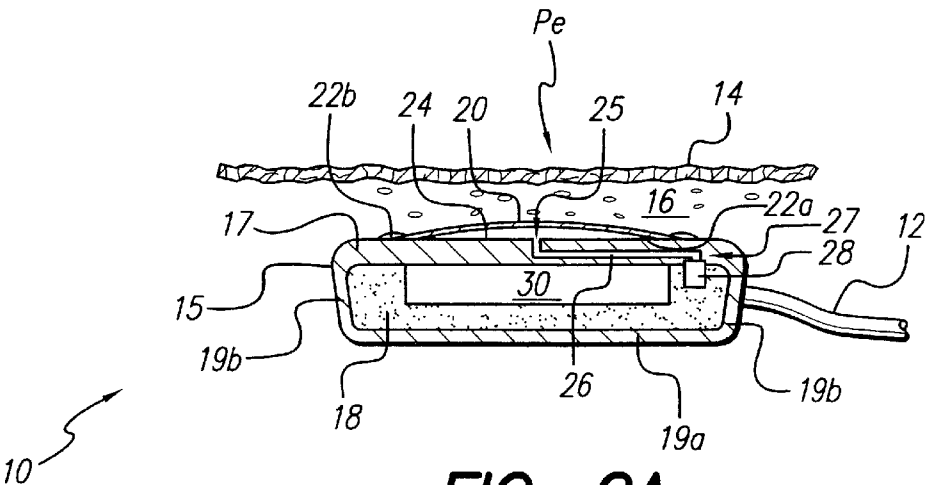
FIG. 2A is a side sectional view of the implantable housing of FIG. 1 when implanted under the skin of a user, and illustrates the main components of the microphone assembly.
Figure 2C:
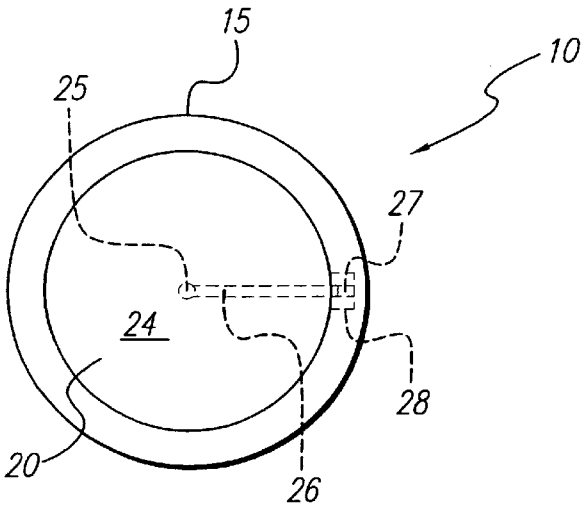
FIG. 2C is an anterior view of the implantable housing of FIG. 1, FIG. 2A or FIG. 2B, looking at the diaphragm side of the implantable housing, i.e., that side which is located closest to the skin when the device is implanted.
Figure 2B:
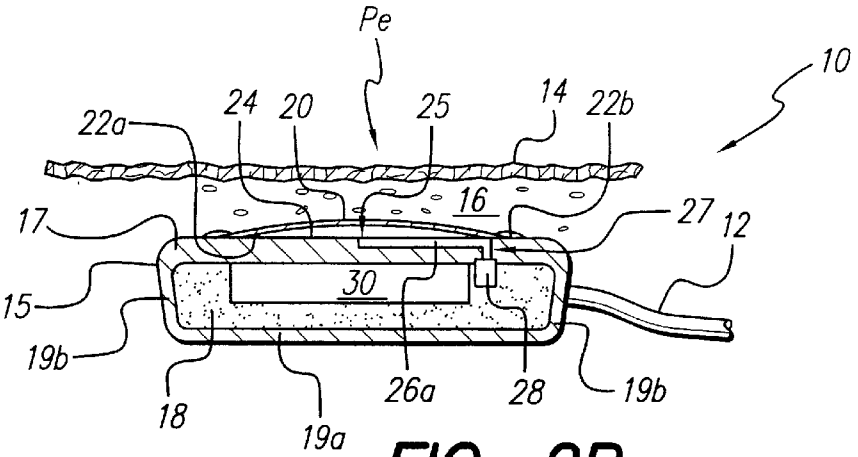
FIG. 2B is a side sectional view as in FIG. 2A, showing an alternative embodiment of the microphone assembly.

A sectional view of one embodiment of the implantable device 10, implanted under the skin 14 of a user, is shown in FIG. 2A, and a sectional view of another embodiment of the implantable device 10 is shown in FIG. 2B. These two embodiments are substantially the same except, as explained below, one (FIG. 2A) employs a channel 26 and the other (FIG. 2B) employs a groove 26*a* to couple pressure from the gap immediately behind the diaphragm 20 to a location near the perimeter of the inside the device 10. A top view of the implantable device 10 is shown in FIG. 2C.

As seen in FIGS. 2A, 2B and 2C, the implantable device 10 is made up of an hermetically-sealed case 15 having an interior space 18. As will become evident from the description that follows, the interior space 18 is pressurized to a desired level. The hermetically sealed case includes an anterior wall 17, a posterior wall 19*a*, and side walls 19*b*. A perimeter portion of the diaphragm 20 is mounted to the outside surface of the anterior wall 17, e.g., using an hermetic weld 22*b* that bonds the periphery of the diaphragm to the anterior wall 17 of the case 15. As needed during fabrication, another weld 22*a*, e.g., a spot weld, may first be made to securely hold the diaphragm 20 in its desired location against an upper surface of the anterior wall 17 as the hermetic weld 22*b* is completed around the entire perimeter of the diaphragm. Various electrical components (not shown in FIG. 2A or 2B), e.g., integrated circuits, capacitors, and transistors that comprise speech processing circuitry, or that perform some other desired function, may be carried or mounted within the interior space 18. Also included within the space 18 is a battery 30.

The battery 30 fills a significant portion of the space 18, with one surface of the battery being attached to the inside of the anterior wall 17 that is below the diaphragm 20.

The diaphragm 20 has a gap 24 behind it. The gap 24 is located so as to be sandwiched between the outside of the anterior wall 17 and the diaphragm 20. The anterior wall 17 is that side of the implantable device 10 that is closest to the skin 14 when the device 10 is implanted, as seen in FIG. 2A or FIG. 2B. Typically, the anterior wall 17 is a flat or planar wall that allows the diaphragm 20 to be mounted against it. In some embodiments of the implantable device 10, the anterior wall 17 may be thicker than the posterior wall 19*a,* or the side walls 19*b.*

A radial acoustic channel 26 passes through the anterior wall 17 and enables the static pressurization within the interior space 18 to reach and pressurize the space within the gap 24. The channel 26 has a first end 25 that is open to the gap 24 at a location that is at or near the center of the gap 24. The channel 26 has a second end 27 that opens into the pressurized space 18 at a location that is underneath and near a point on the perimeter of the diaphragm 20. A pressure transducer 28 is mounted to the anterior wall 17 at the second end 27 of the channel 26. The pressure transducer 28 resides inside the pressurized space. The pressure transducer 28 senses changes in the sound pressure within the gap 24, caused by movement or deflection of the diaphragm 20, and converts the sensed sound into an electrical signal. The electrical signal, in turn, is input to appropriate electronic circuitry that amplifies and filters the signal, as required, in order to provide an effective microphone signal.

The pressure transducer 28 (also referred to as an acoustic transducer) may be of conventional design, as is commonly used in microphones known in the art.

The second end 27 of the radial acoustic channel is also in fluid communication with the interior pressurized space 18 inside the hermetically-sealed case 15. (As used herein, the phrase "fluid communication" means that substantially the same pressure exists at all points which are in fluid communication with each other. Also, as used herein, the term "fluid" refers to any substance that can readily flow or compress, whether a liquid or a gas.) This occurs because neither the construction of the acoustic transducer 28 nor its installation into the anterior wall 17 of the device 10 is hermetic. Thus, the pressurization of the space 18 is also transferred to channel 26 and the gap 24, thereby lifting the diaphragm 20 away from the surface of the case 15, and forming the smallest possible gap 24. In this lifted position, the diaphragm 20 is thus free to move or deflect in response to external sound pressure Pe, which external sound pressure Pe is transferred through the skin 14 and connective tissue 16.

It should be noted that when the diaphragm 20 is initially peripherally mounted to the outside surface of the anterior wall 17, e.g., by means of an hermetic weld 22*b* that bonds the perimeter of the diaphragm 20 to the anterior wall, the entire diaphragm lies more or less flush against the surface of the anterior wall. Then, when the interior space 18 is pressurized, the internal pressure, coupled through the transducer 28 and radial channel 26 to the underneath side of the diaphragm 20, lifts the diaphragm 20 and creates the smallest possible gap 24. (In this regard, it should also be noted that the height of the gap 24 shown in FIGS. 2A and 2B is greatly exaggerated in order to more clearly show in these figures the existence of the gap.) When the gap 24 is thus established, and the diaphragm is deflected, e.g., by sound pressure Pe, both the deflection and deflection slope of the diaphragm are zero at the circumference of the diaphragm.

An alternative embodiment of the invention, shown in FIG. 2B, couples the pressure variations that occur within the gap 24 to the transducer 28 by way of a groove 26*a* formed in the upper surface of the anterior wall 17 rather than through a channel 26 formed within the anterior wall 17, as previously described. The groove 26*a* performs the same function of the channel 26 previously described because, for all practical purposes, the groove 26*a* is converted to a channel by the inside surface of the diaphragm 20 (i.e., that surface facing the anterior wall 17), which inside surface effectively covers the groove 26*a*. The dimensions (effective cross-sectional area, e.g., width and height) of the groove 26*a* are large compared with the gap spacing (height). As the groove 26*a* gets closer to the perimeter of the diaphragm 20, the gap becomes smaller and smaller until at the perimeter the gap is zero. Hence, for all practical purposes relative to the present invention, the groove 26*a* functions the same as the channel 26, and transfers sound sensed in the gap 24 to the transducer 28. The advantage of using a groove 26*a* instead of a channel 26 is that a groove is generally easier to manufacture, i.e., machine or mill and inspect, than is a closed channel.

Figure 2E:
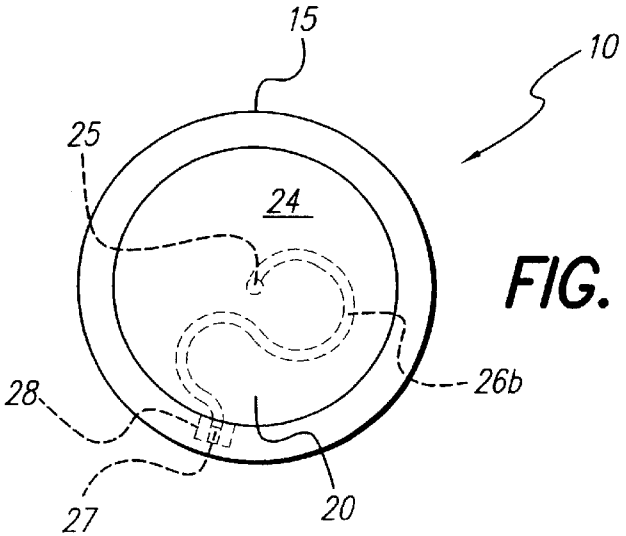
FIG. 2E is an anterior view of the implantable housing as in FIG. 2C or FIG. 2D, showing another alternative embodiment wherein the channel or groove follows a serpentine path rather than a straight radial path.
Figure 2D:
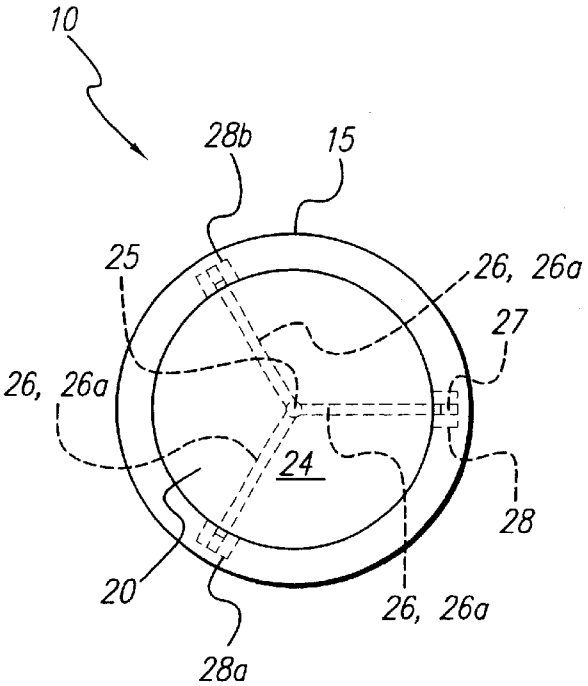
FIG. 2D is an anterior view of the implantable housing as in FIG. 2C, showing an alternative embodiment wherein multiple channels or grooves are formed in the anterior wall.

FIGS. 2D and 2E show additional variations of the invention relative to the number of channels 26 or grooves 26*a* that are employed, and the path that the channel 26 or groove 26*a* takes as it travels from near the center of the anterior wall 17 to near its perimeter. More particularly, FIG. 2D illustrates that more than one channel 26 or groove 26*a,* each having its own transducer 28, may be used to sense the pressure variations that occur in the gap 24. FIG. 2E illustrates that, although the channels 26 or grooves 26*a,* generally follow a radial path, i.e., a straight line that begins at a first end 25 located near the center of the diaphragm and ends at a second end 27 located near the perimeter of the diaphragm, such a straight line path is not necessary. That is, as shown in FIG. 2E, the channel 26, or groove 26*a,* may actually follow a serpentine path as it traverses from the first end 25 near the center of the diaphragm to the second end 27 near the perimeter of the diaphragm. Thus, for example, the channel 26, or groove 26*a,* may assume somewhat of an "S" or "?" shape as seen in FIG. 2E. Alternatively, the channel 26 or groove 26*a* may follow a spiral path from first end 25 to second end 27. As the length of the channel 26 or groove 26*a* increases, acoustic mass is added to the overall acoustic mass of the microphone assembly. However, the acoustic mass of the channel or groove is only a very small component of the overall acoustic mass, which overall acoustic mass is largely determined by the acoustic mass of the skin 14. Hence, it is seen that the actual path followed by the channel 26 or groove 26*a* as it traverses between first end 25 and second end 27 is not critical to the present invention.

Thus, as used herein, it is to be understood that the term "channel," when referring to the means for providing acoustic coupling from the gap 24 to the pressurized interior of the implantable device, shall mean any fluid communication means between the gap 24 and the interior of the implantable device, including a closed channel 26 formed inside of the anterior wall 17 (as shown in FIG. 2A), or a groove 26*a* that is substantially covered by the diaphragm 20 (as shown in FIG. 2B), or any other type of channeling means; and without regard to whether such channeling means follows a path that is radial, serpentine, spiral, or other shape.

Additional mechanical details associated with a microphone assembly made in accordance with one of several embodiments of the invention are illustrated in FIGS. 3A–3D.

Figure 3C:
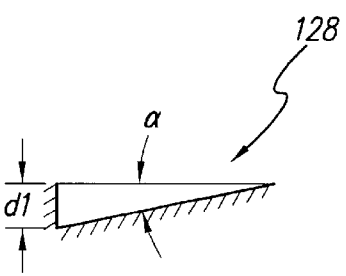
FIG. 3C illustrates additional detail associated with a small cut made in the anterior wall near the perimeter of the microphone diaphragm of the microphone assembly embodiment of FIG. 3A.
Figure 3A:
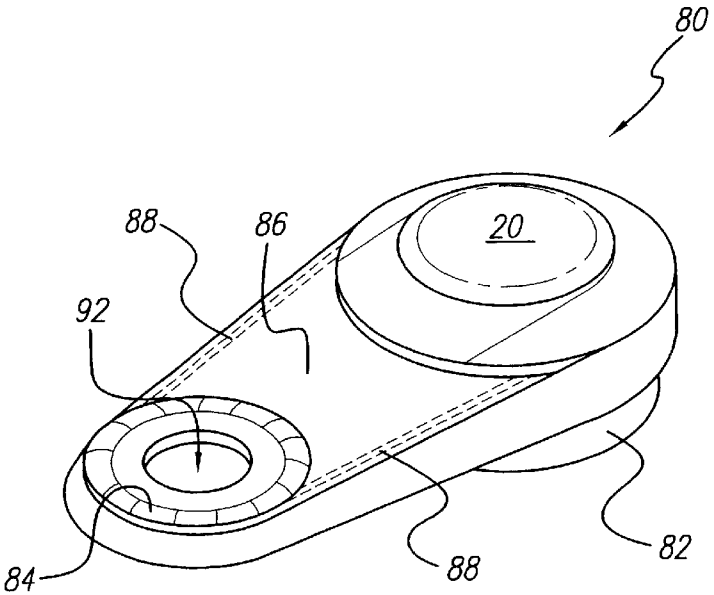
FIG. 3A depicts a perspective view of a microphone assembly made in accordance with one of several embodiments of the invention.

FIG. 3A depicts a perspective view of an implantable device 80 that includes a microphone assembly made in accordance with the teachings of the present invention. The device 80 has an hermetically-sealed case 82 to which a microphone diaphragm 20 has been mounted. An antenna coil 84 is also attached to the case 82. The antenna coil 84, which may be used both for transmitting and receiving electromagnetic or rf signals, is embedded within a silicone antenna molding 86. The silicone molding 86 is mechanically attached to the case 82. The antenna coil 84 has wires 88 that are electrically connected to electronic circuitry contained within the sealed case 82 by way of an hermetically-sealed feed-through terminal 90 (see FIG. 3B, below). The antenna molding 86 further has a locking hole 92 formed therein, e.g., so as to reside in the center of the antenna coil 84.

Figure 3B:
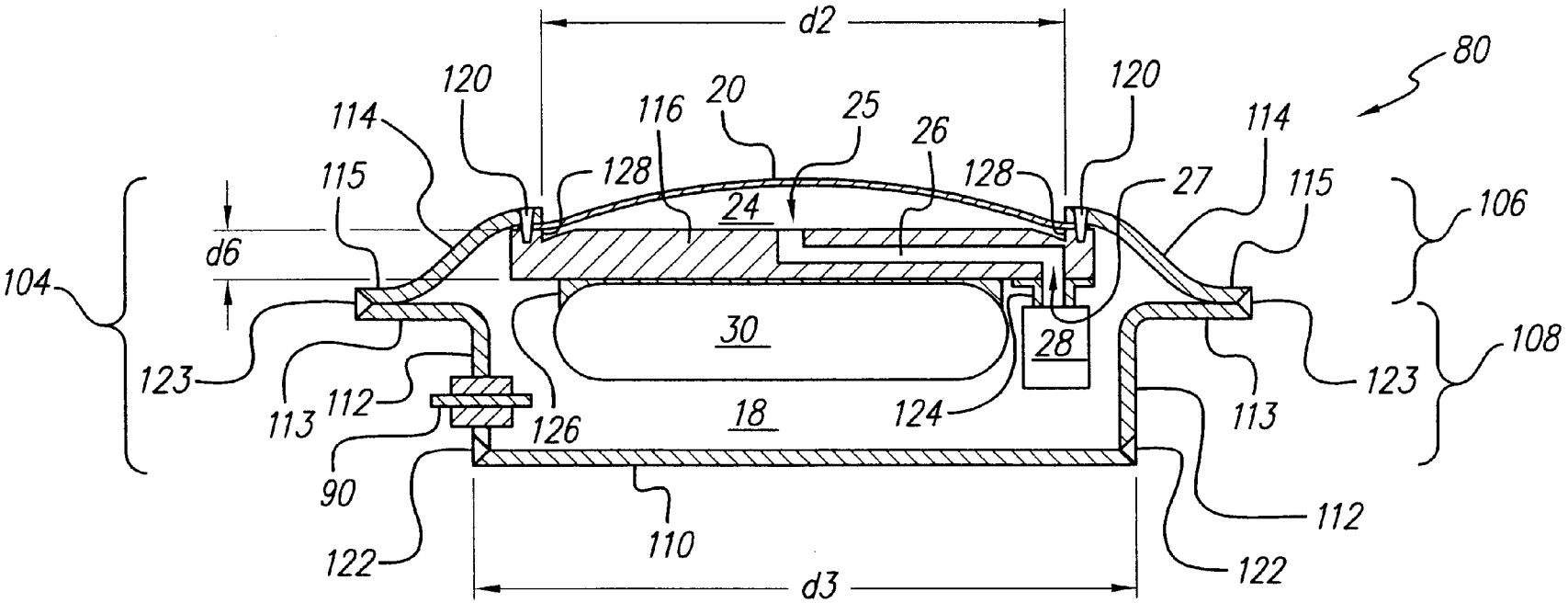
FIG. 3B is a cross-sectional view of the microphone assembly embodiment of FIG. 3A.

FIG. 3B shows a cross-sectional view of the implantable device 80, which device 80 includes a microphone assembly made in accordance with the principles of the present invention. As seen in FIG. 3B, the device 80 includes an hermetically sealed case 104. Typically, the case 104 comprises a clam-shell construction having a lower, or posterior, portion 108, and an upper, or anterior, portion 106.

Each portion of the claim shell case 104 includes constituent parts. For example, the posterior portion 108 includes a posterior wall 110 and side walls 112. The side walls 112 are bent to form a first flange 113. Feed through terminals 90 pass through the side wall 112, as required, in order to permit electrical connection to be made through the wall. The anterior portion 106 includes a rim 114 and an anterior plate 116. The rim 115 has its outer portion bent to form a second flange 115.

The diaphragm 20 is hermetically bonded at its perimeter to the perimeter of the anterior plate 116 and to the inside edge of the rim 114. One way to make this hermetic bond is by way of a weld 120. The weld 120 may be accomplished using conventional laser welding techniques through two layers and into a third layer, i.e., through the rim 114, through the diaphragm 20, and into the anterior plate 116.

The posterior wall 110 and side walls 112 are hermetically joined by a weld seam 122. Similarly, the first flange 113 and the second flange 115 are hermetically bonded together using a weld seam 123. In some embodiments, the posterior portion 108 of the clam shell case 104 may be press formed using an integral piece of metal, thereby obviating the need for the weld seam 122. In other embodiments, the weld seam 122 is performed last, after the antenna molding 88 (FIG. 3A) and all electronic components have been inserted inside the assembly.

An access hole, or valve, may be included within the posterior portion 108 of the case 104, or elsewhere, to facilitate pressurizing the interior volumes of the case 104. Once the desired level of pressurization has been achieved, such access hole, when used, is hermetically sealed. Other pressurization techniques known in the art may also be used, e.g., assembling the case 104 in a pressurized chamber. The pressurized fluid inserted into the interior volumes may be any suitable fluid, whether liquid or gas. Typically, for a microphone assembly, a gas is used, such as air or nitrogen, and preferably an inert gas is used, such as helium. Inserting a pressurized helium gas inside the hermetically sealed case allows conventional hermeticity (leakage) tests to be performed during assembly of the device using existing helium sniffer test devices.

As described previously in conjunction with the description of FIGS. 2A and 2B, a channel 26 (or groove 26*a* or other channeling means) is formed in or on the anterior wall 116 having a first end 25 that opens at or near the center of the diaphragm 20, and having a second end 27 that opens at or near the periphery of the anterior wall 116. A pressure transducer 28 is mounted to the inside of the anterior wall 116 at the point where the second end 27 of the channel 26 is located. A holding flange 124, spot welded to the inside of the anterior wall 116 over the end 27 of the channel 26, facilitates mounting the pressure transducer 28 at this location.

The battery 30 is mounted to the inside of the anterior wall 116 using an appropriate epoxy, glue or other bonding agent 126.

Once the clam shell construction of the hermetically-sealed case 104 is completed, and all of the electrical components are mounted therein, the interior of the case is pressurized to a desired pressure, e.g., 2 to 10 psig. (Note: "psig" stands for pounds per square inch gauge, and constitutes a pressure measurement relative to the ambient pressure. Thus, a pressure of 5 psig means a pressure that is 5 psi greater than the ambient pressure.) Such pressure is distributed throughout the interior of the case, including through the channel 26 (or groove 26*a*) to the backside of the diaphragm 20, and lifts the diaphragm 20 away from the anterior wall 116 to form a gap 24.

A groove 128 is preferably formed around the perimeter of the anterior plate 116, as shown in FIG. 3B. Such groove, in one embodiment, has a depth d1 of about 0.025 mm with a cut angle $\alpha$ of about 3 degrees, where d1 and $\alpha$ are defined as shown in FIG. 3C. The presence of such groove helps assure that a gap 24 is present behind the diaphragm 20 once the interior space of the case has been pressurized.

It should be noted that the anterior plate 116 is preferably thick and rigid compared to the thickness of the other walls, i.e., the side wall 112, the posterior wall 110, and the anterior rim 114, of the implantable case 104, and especially compared to the thickness of the diaphragm 20. Such thick anterior plate 116 protects the thin diaphragm 20 from damage, allowing the diaphragm 20, when pushed, to vent against the anterior plate 116.

Although the materials and component sizes used with the implantable device 80 may change, depending upon the specific application and use of the implantable device 80 with which the microphone assembly is used, some representative materials and sizes that may be used when making a microphone assembly in accordance with the present invention are as follows:

The case walls, i.e, the side wall 112, posterior wall 110, and anterior rim 114, must be made from a metal that is compatible with body tissue. Stainless steel or titanium may be used. A preferred material is titanium, or an alloy of titanium, having a thickness of between about 0.2 and 0.4 mm. The diameter d3 of the case 104, not including the flanges 113, 115, is preferably about 29 mm. This is also the approximate diameter of the anterior plate 116, although typically the anterior plate 116 will be slightly less than the diameter of the posterior wall 110. The overall depth d5 of the case 104 (see FIG. 3D) is about 11 mm. The overall depth d4 (see FIG. 3D) of the posterior portion 108 of the case 104 is about 6 mm. The thickness d6 of the anterior plate 116 is about 1 mm.

The diaphragm 20 is preferably made from titanium foil, having an active diameter d2 of about 22 mm. (Note, the "active diameter" is that portion of the diaphragm capable of having a gap 24 formed behind it.) The thickness of the foil from which the diaphragm 20 is made should be between about 0.05 mm and 0.25 mm. When the interior of the case 104 is pressurized to a pressure of between about 2–10 psig, the height of the gap 24 at the center of the diaphragm 20 ranges between about 0.01 mm to 0.10 mm, or in some instances (with higher internal pressure) as high as 0.20 mm. (Note, when the internal pressure is 0 psig, the gap height is 0 mm).

The pressure transducer 28 may be a commercially available KNOWLES microphone transducer, FG series, or similar transducer.

The channel 26 (or other channeling means, such as a covered groove 26*a*) formed within or on the anterior plate 116 is about 11–12 mm long, and has a rectangular cross section that is about 0.53×0.53 mm. (Alternatively, the channel may have circular cross section with a diameter of about 0.5–0.7 mm. If a groove 26*a* is employed, it may have a triangular cross section area of about 0.2–0.3 $mm^2$.) As has been stated previously, neither the microphone transducer 28, nor its connection to the inside of the anterior plate 116 (e.g., through use of the holding flange 124) is hermetic. Thus, the internal static pressure within the hermetically sealed case 104 is the same throughout all interior volumes, i.e., the static pressure is the same in the interior space 18, as well as in the channel 26 (or groove 26*a*) and in the gap 24.

Figure 3D:
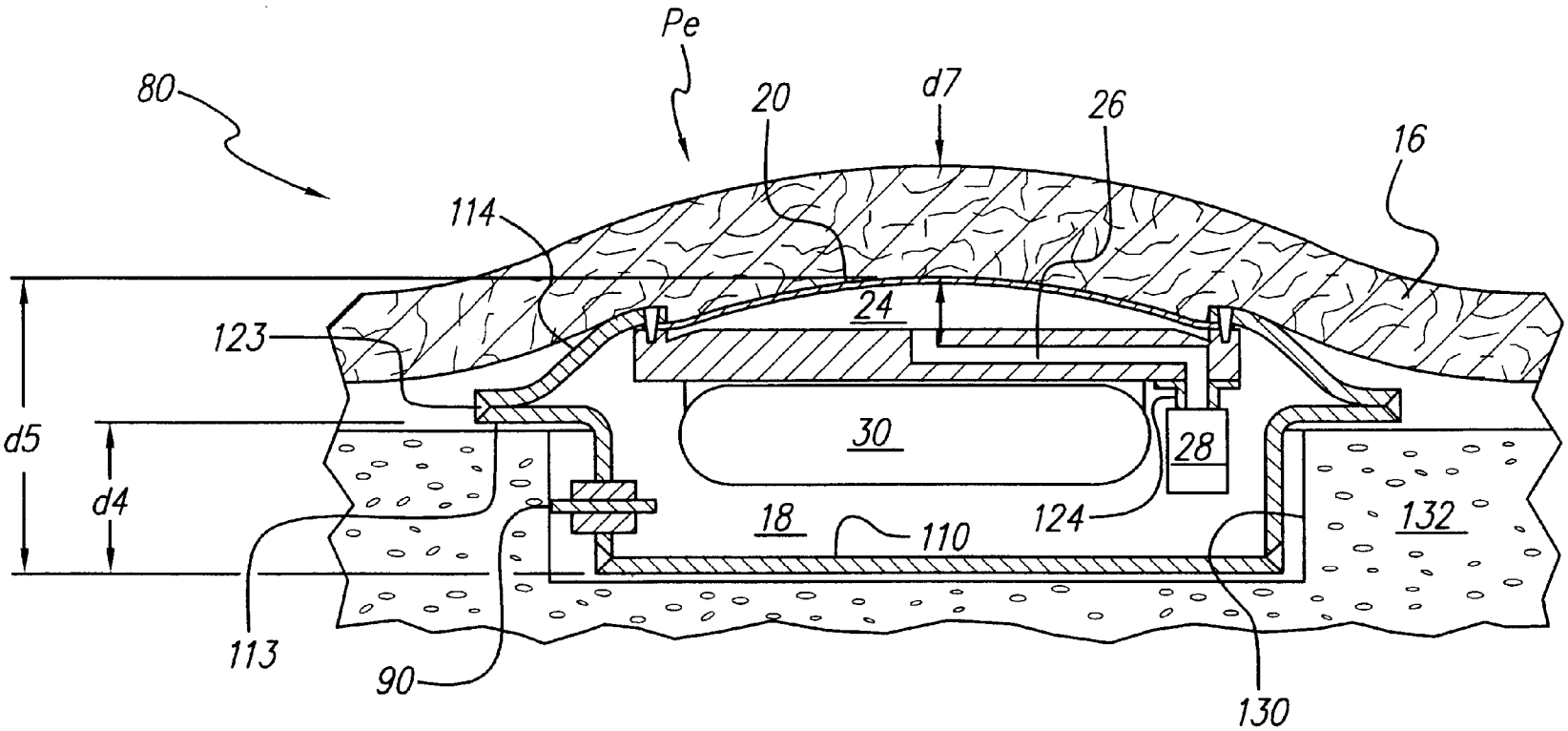
FIG. 3D shows the a sectional view of the microphone assembly of FIG. 3A implanted under the skin of a user and residing in a pocket made in the skull bone of the user.

FIG. 3D shows the a sectional view of the implantable device 80 implanted under the skin 14 and tissue 16 of a user, and residing in a pocket 130 made in the bone 132 of the user. The combined thickness d7 of the skin 14 and tissue 16 for most adult users ranges from about 5–10 mm. The overall depth d5 of the implant device 80 is about 11 mm. The depth of the pocket 130 formed in the bony tissue 132 is slightly greater than the distance d4 between the flange 113 and the posterior wall 110. This distance d4 is about 6 mm. Note that the flange 113 rests on the bone 132 around the edge of the pocket 130. For a typical FICS application, both the implantable device 80 (which would house the speech processor, microphone, and battery) and the implantable cochlear stimulator (ICS) 94 (see FIG. 3B) are placed in respective pockets formed in the skull of the user. Then, the silicone molds and embedded coils that couple the two devices together, are positioned on top of the bone 132 between the pockets, but under the skin 14 and tissue 16.

In operation, external sound pressure Pe acts on the skin 14 above the location where the device 10 or 80 is implanted. Such pressure continues through the skin 14 and connective tissue 16 and acts on the diaphragm 20, causing the diaphragm 20 to deflect, flex, or move. Such movement, in turn, is transferred to a change in pressure within the gap 24. This change in pressure is coupled through the acoustic channel 26 (or other channeling means, such as a covered groove 26*a*) to the pressure transducer 28, where it is sensed and converted to an electrical signal.

The thickness or height of the gap 24 is minimized in order to maximize its acoustic stiffness. This maximized acoustic stiffness, in turn, increases the bandwidth, and together with the low equivalent volume of the acoustic transducer 28 minimizes the drop in sound pressure across the diaphragm 20.

The thickness of the diaphragm 20 is increased to further increase stiffness and bandwidth, although such occurs at the expense of a slight increase in pressure drop across the diaphragm 20. Because increased diaphragm thickness also increases acoustic mass, it also reduces the sensitivity of bandwidth to small variations in the thickness of tissue over the diaphragm 20. Typically, as seen in FIG. 3D, the skin and tissue thickness over the diaphragm ranges from about 5 mm to about 10 mm for most adults.

The area of the diaphragm 20 is made as large as possible in order to maximize its deflection in response to external sound pressure. As indicated above, a representative diaphragm 20 has an active diameter d2 of about 22 mm, which means the diaphragm area is about 380 $mm^2$. In order to avoid severe high frequency radial attenuation in the gap 24, it is necessary that sound pressure in the gap be monitored at or near the center of the diaphragm 24. For this purpose, the opening 25 of the acoustic channel 26 (or groove 26*a*) is placed at or near a location that is below the center of the diaphragm 24, and the acoustic (or pressure) transducer 28 is located at a second opening 27 of the channel 26 that is at a location that is near the perimeter of the diaphragm 20 (and thereby out of the way of the battery 30). However, due to the high acoustic stiffness of the gap 24, the acoustic transducer 28 monitors pressure changes as though it were physically located at the center of the diaphragm. That is, because of the high acoustic stiffness of the gap 24, the Helmholtz resonance normally associated with such a probe-tube system does not occur, and the acoustic mass of the channel 26 (or covered groove 26*a*) simply adds to the acoustic mass of the tissue covering the diaphragm 20. Since the combined acoustic mass of the tissue and the diaphragm is significantly greater than the acoustic mass of the channel 26 (or grove 26*a*), the probe-tube system illustrated in FIGS. 2A and 2B behaves as if the acoustic transducer 28 were installed directly below the center of the diaphragm. Moreover, the acoustic transducer 28 advantageously has a very small equivalent volume, which small equivalent volume minimizes the pressure drop across the diaphragm 20.

Figure 4:
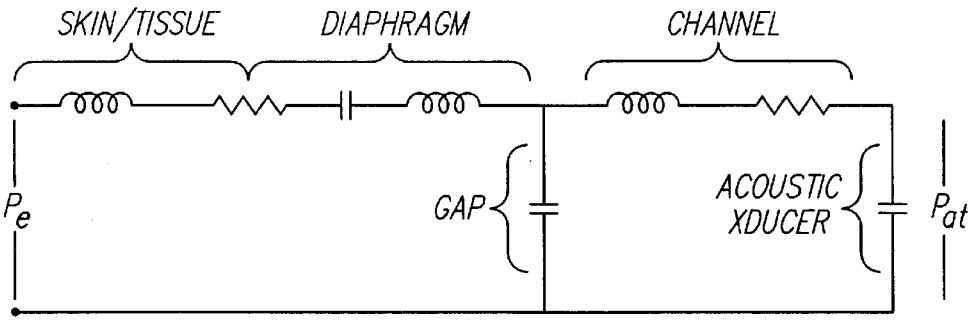
FIG. 4 is a simplified electrical network equivalent model of the microphone assembly of the present invention.

To better understand the operation of the microphone assembly of the present invention, a simplified lumped-element electrical network model of the microphone assembly is shown in FIG. 4. In the network model, electrical inductance represents acoustic mass, electrical capacitance represents acoustic compliance, and electrical resistance represents acoustic resistance. The external sound pressure Pe, which impinges on the surface of the skin 14, is input to the model. The output of the model is the sound pressure, Pat, measured by the acoustic transducer. Pg is the sound pressure in the gap 24 below the center of the diaphragm. Because the gap 24 and its associated acoustic compliance are very small, the capacitance representing it in the model is negligible. As a result, all of the remaining significant elements are in series, and the transfer function relationship Pat/Pe is that of a second order low pass filter. The resonant frequency and associated bandwidth of the filter are determined by the series combination of the acoustic mass of the tissue, diaphragm and channel, and by the series combination of the acoustic compliance of the diaphragm and the acoustic transducer.

Figure 5:
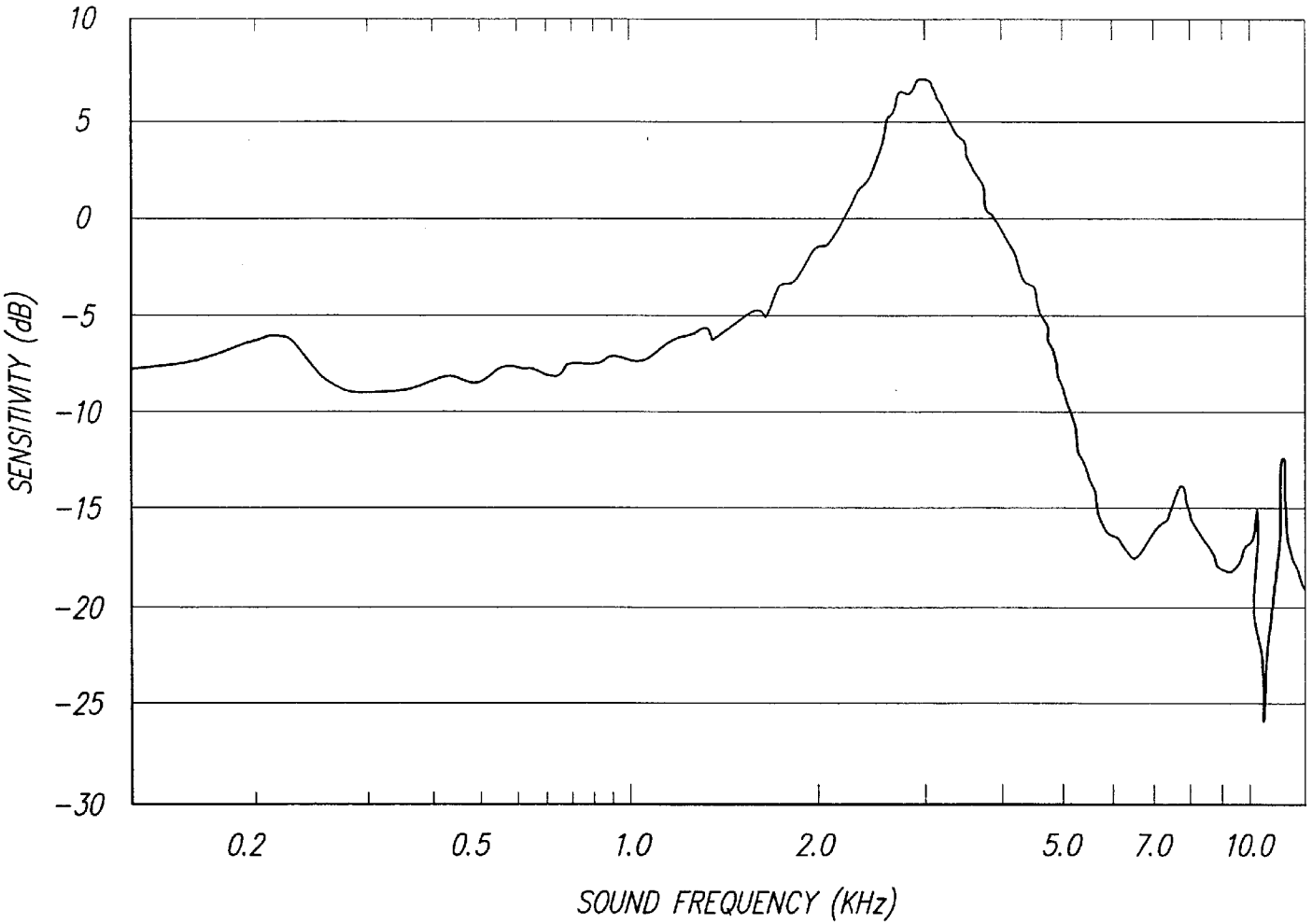
FIG. 5 is a graph showing the measured frequency response of the microphone assembly; and Corresponding reference characters indicate corresponding components throughout the several views of the drawings.

The measured frequency response of a physical model of the microphone assembly of the present invention is shown in FIG. 5. For the response shown in FIG. 5, a 6 mm-thick beefsteak was placed over the diaphragm in order to simulate the effects of the skin and connective tissue. In FIG. 5, sound frequency is shown on the horizontal axis. The response sensitivity is shown on the vertical axis. The response sensitivity is shown in dB relative to the pre-installation sensitivity of the acoustic transducer. Note, as seen in FIG. 5, the overall response is that of an under-damped second-order low-pass filter. Note also that the loss in low-to-mid-frequency sensitivity is only about 7 dB. Stated differently, the microphone assembly does not degrade the signal-to-noise ratio by more than approximately 7 dB at low-to-medium frequencies. This small sensitivity loss represents a significant improvement over known implantable microphones. Additionally, note that the unequalized system bandwidth is approximately 4.8 KHz. This unequalized bandwidth can be equalized by analog or digital filtering to within ±2 dB over the frequency range from 100 Hz to 5 KHz. Also, it should be pointed out that the resonance peak shown at about 3 KHz (FIG. 5) can be reduced, thereby providing one form of equalization, by adding acoustic resistance elements at either the first end 25 or the second end 27 of the channel 26 or groove 26*a*. Alternatively, or conjunctively, appropriate acoustic resistance elements can be inserted into the channel 26 or groove 26*a*, such as steel wool or cotton.

Thus, it is seen that the microphone assembly configuration taught herein provides an implantable microphone assembly that offers a significant increase in frequency response (or bandwidth) than has heretofore been achievable with implantable microphone assemblies. Whereas prior art implantable microphones offered a bandwidth on the order of only a few hundred Hertz, or at most about 2.5 KHz, the present invention provides a bandwidth on the order of 5 KHz. Such increased bandwidth, in turn, allows the user of the microphone to capture and sense more sound than has previously been possible. Advantageously, with such increased bandwidth, the overall performance of the implantable hearing prosthesis, or other hearing device used with the microphone, can be significantly enhanced.

It is anticipated that the bandwidth of the microphone assembly will be on the order of 5–7 KHz as the various parameters associated with the microphone assembly are optimized.

As indicated in FIG. 2D, some of the various embodiments of the microphone assembly of the present invention may include more than one channel 26 (or groove 26*a*), e.g., a plurality of channels and/or grooves, within or on the anterior wall 17 or anterior plate 116. Each of the plurality of channels or grooves, when used, have a first end that is open at or near the center of the underneath side of the diaphragm, and a second end that opens into the interior space 18 near the periphery of the case 15 or 104. A separate pressure transducer is mounted at the second end of each channel so as to sense pressure variations that occur in the gap 24. The various pressure transducers thus employed may be selected to have different characteristics so as to enhance to the overall frequency response obtained from the combination of such transducers. Alternatively, the various pressure transducers may have the same, or approximately the same, characteristics in order to provide component redundancy, and to thereby improve the overall reliability of the assembly. Additionally, the use of more than one channel with accompanying transducer improves the signal-to-noise ratio.

While the invention herein disclosed has been described by means of specific embodiments and applications thereof, numerous modifications and variations could be made thereto by those skilled in the art without departing from the scope of the invention set forth in the claims.

What is claimed is:

1. An implantable microphone assembly comprising:

an hermetically sealed case, the hermetically sealed case having a posterior wall, an anterior wall, and side walls that surround and enclose a pressurized space within the hermetically sealed case;

a diaphragm having a perimeter portion and a central portion, wherein the perimeter portion of the diaphragm is hermetically mounted to the outside of the anterior wall of the hermetically sealed case, and wherein a central gap exists between the central portion of the diaphragm and the anterior wall;

an acoustic channel having a first end that opens into the central gap at a location that is near the center of the diaphragm, and a second end that opens to the pressurized space inside the hermetically sealed case at a location that is near the perimeter of the diaphragm; and an acoustic transducer mounted to the anterior wall within the pressurized space at the second end of the acoustic channel, the acoustic transducer including means for converting sensed pressure variations to an electrical signal, and wherein deflections of the central portion of the diaphragm create pressure variations in the gap and acoustic channel that are sensed by the acoustic transducer; whereby the acoustic transducer produces an electrical signal representative of external pressure variations that deflect the diaphragm.

2. The implantable microphone assembly of claim 1 wherein the pressurized space within the hermetically sealed case further includes a battery mounted to the anterior wall below the central gap.

3. The implantable microphone assembly of claim 2 wherein the anterior wall is thicker than the posterior wall.

4. The implantable microphone assembly of claim 3 wherein the pressurized space within the hermetically sealed case further includes speech processing circuitry adapted to receive and respond to the electrical signal produced by the acoustic transducer.

5. The implantable microphone assembly of claim 1 wherein the microphone assembly has a bandwidth of at least 5 KHz.

6. The implantable microphone assembly of claim 1 wherein the microphone assembly does not degrade the signal-to-noise ratio by more than approximately 7 dB at low-to-medium frequencies.

7. The implantable microphone assembly of claim 1 wherein the perimeter portion of the diaphragm is hermetically welded to the outside surface of the anterior wall.

8. The implantable microphone assembly of claim 7 wherein the acoustic transducer in the pressurized space is mounted near the perimeter of the pressurized space adjacent the side wall.

9. The implantable microphone assembly of claim 7 wherein the acoustic channel comprises a radial acoustic channel formed integral with the anterior wall.

10. The implantable microphone assembly of claim 7 wherein the acoustic channel comprises a groove formed within the anterior wall.

11. The implantable microphone assembly of claim 7 wherein the acoustic channel comprises a non-radial channel formed integral with the anterior wall.

12. An implantable microphone assembly for use with an auditory prosthesis comprising:

an hermetically sealed case;

a microphone diaphragm mounted to an outside surface of said case;

wherein said diaphragm is mounted so there is a gap behind the diaphragm which allows the diaphragm to deflect in response to external forces; and an acoustic transducer mounted within said hermetically sealed case, wherein said acoustic transducer is in fluid communication with the gap behind the diaphragm.

13. The implantable microphone assembly of claim 12 wherein the acoustic transducer is mounted near the perimeter of the hermetically sealed space.

14. The implantable microphone assembly of claim 13 further including:

an hermetic weld around a perimeter of said diaphragm;

a channel integral with a wall of said hermetically sealed case that opens at a point centrally located underneath the diaphragm; and a sufficient pressure within said hermetically sealed case to lift the diaphragm away from the case and create the gap behind the diaphragm.

15. The implantable microphone assembly of claim 14 wherein the channel comprises a channel that passes radially through the wall of said hermetically sealed case.

16. An implantable microphone assembly for use with an auditory prosthesis comprising:

an hermetically sealed case having an anterior wall, a posterior wall, and a side wall, said walls defining an hermetically-sealed interior volume in which electronic components are housed;

a microphone diaphragm hermetically mounted at its perimeter to an outside surface of said anterior wall;

a pressurized fluid contained within the hermetically-sealed interior volume;

a channel passing through the anterior wall that is in fluid communication with the interior volume of the hermetically sealed case; the channel having an opening located behind the diaphragm at a location that is at or near the center of the diaphragm, wherein the pressurized fluid lifts the diaphragm away from the anterior wall to form a gap behind the diaphragm, and wherein the presence of the gap allows the diaphragm to deflect in response to external pressure; and a pressure transducer mounted on the anterior wall within said interior volume at the location where the channel passes into the interior volume, wherein the pressure transducer is adapted to sense variations in pressure occasioned by deflection of the microphone diaphragm, wherein the pressure transducer generates an electrical signal in response to the sensed pressure variations.

17. The implantable microphone assembly of claim 16 wherein the anterior wall has a thickness of approximately 1 mm, and the diaphragm comprises a thin metal foil having a thickness of between about 0.05 mm to 0.25 mm.

18. The implantable microphone assembly of claim 16 wherein the pressurized fluid within the interior volume lifts the center of the diaphragm away from the anterior wall a distance of between about 0.010 mm to 0.200 mm, whereby the gap behind the diaphragm has a height of zero at its perimeter and about 0.010 mm to 0.200 mm at its center.

19. The implantable microphone assembly of claim 18 wherein the channel has a first opening that opens into the gap at a point underneath the diaphragm at or near the center of the diaphragm, and a second opening that opens into the interior volume at a point near the perimeter of the interior volume, and wherein the pressure transducer is mounted to the anterior wall at a location near the perimeter of the interior volume.

20. The implantable microphone assembly of claim 19 wherein the pressurized fluid contained within the interior volume comprises a pressurized gas.

21. A method of making an implantable microphone assembly comprising:

(a) making an anterior wall, a posterior wall, and a side wall that can be joined together to form an hermetically-sealed case;

(b) forming a channel that passes through the anterior wall, the channel having a first opening near the center of an outside surface of the anterior wall, and a second opening hear the perimeter of an inside surface of the anterior wall;

(c) hermetically welding a thin diaphragm at its perimeter to the outside surface of the anterior wall, wherein the diaphragm covers the first opening of the channel at or near the center of the diaphragm;

(d) mounting a pressure transducer to the inside surface of the anterior wall so as to cover the second opening, wherein the pressure transducer includes means for converting sensed pressure to an electrical signal;

(e) mounting and assembling other electronic components to the anterior wall or side all;

(f) hermetically welding the anterior wall and posterior wall to the side wall to form an hermetically-sealed case having an interior volume wherein the pressure transducer and electronic components are housed;

(g) pressurizing the interior volume to a prescribed static pressure, wherein the prescribed static pressure is coupled through the channel to behind the diaphragm and lifts the diaphragm away from the outside surface of the anterior wall to form a gap of 0.200 mm or less between the anterior wall and a center region of diaphragm, wherein deflections exerted against the diaphragm from external pressure cause internal pressure variations in the gap that are coupled through the channel and sensed at the pressure transducer, which pressure variations are manifest in the electrical signal generated by the pressure transducer.

* * * * *